United States Patent [19]

McNelley, Jr.

[11] 4,227,277

[45] Oct. 14, 1980

[54] MOP HEAD

[75] Inventor: H. William McNelley, Jr., Blairsville, Ga.

[73] Assignee: American Associated Companies, Atlanta, Ga.

[21] Appl. No.: 13,040

[22] Filed: Feb. 21, 1979

[51] Int. Cl.[3] ..... B05C 17/10

[52] U.S. Cl. ..... 15/229 R

[58] Field of Search ..... 15/228, 229, 226, 115, 15/116 R, 119 R, 120 R

[56] References Cited

U.S. PATENT DOCUMENTS

| | | | |
|---|---|---|---|
| 1,406,966 | 2/1922 | Bienstock | 15/229 R |
| 1,566,544 | 12/1925 | Krebs | 15/229 R |
| 1,775,235 | 9/1930 | Carlson | 15/229 A X |
| 2,671,922 | 3/1954 | Lower et al. | 15/229 R |
| 3,216,039 | 11/1965 | McNelley, Sr. et al. | 15/229 A |
| 3,321,903 | 5/1967 | Tanzer | 15/229 R X |

*Primary Examiner*—Philip R. Coe

*Attorney, Agent, or Firm*—Louis T. Isaf

[57] ABSTRACT

A roofer's mop comprises a plurality of glass yarns with randomly disposed fibers bound together in a fixture to provide a lightweight, bulky mop head which will withstand temperatures in excess of 800° F. to spread molten tar for prolonged periods of usage.

3 Claims, 3 Drawing Figures

MOP HEAD

DESCRIPTION

BACKGROUND OF THE INVENTION

This invention relates generally to an improvement in mops used by roofers to spread hot tar, and more specifically to an improvement in glass mop heads.

In the roofing of many buildings, especially commercial structures, hot tar or asphalt, referred to in the trade as "hot stuff", is widely used as a binder and sealant and must be heated to temperatures of about 400° to 500° F. in order to be thin enough to spread. The "hot stuff" is generally mopped on the roof by hand. The mops which are used to mop on the "hot stuff" must be able to stand up to rigorous requirements both as to tensile and abrasive strength and as to resistance to high temperatures.

For clarity, the following terms, as used herein, are defined:

(1) a fiber or filament is the most basic element of the composite yarn, being extruded, drawn, spun or otherwise formed into a single elongated element;

(2) twisted means wound or wrapped around each other. Twisting imparts a spiral or circular form, as by turning at either end.

Cotton, and to a very limited extent rayon—another cellulosic type fiber, is by far the most commonly used mop yarn. The yarns are somewhat bulky or "full-bodied" with low density and, therefore, a bulky mop head can be made weighing only about two and one-half to three pounds. A problem, however, is that cotton mop heads have a relatively short useful life, usually lasting only one full day of work. This short life is due to a combination of factors including particularly abrasive wear on the yarns and high tar temperatures.

Yarns comprising glass fibers are also used to make mopheads, but prior art mopheads fabricated from glass fibers comprise a much smaller share of the market than do cotton mop heads. The glass yarns in mop heads have a higher tensile and abrasive strength than cotton yarns and a higher resistance to increased temperatures. However, glass yarns used in prior art mop heads are less "full bodied" having a greater density than cotton yarns, and, therefore, many more glass yarns must be used to achieve a mop head of the same bulk as a cotton mop head. The prior art yarns of glass fibers will not hold as much of the "hot stuff" per pound as will the cotton yarns, apparently because the glass has a smoother surface with a lower coefficient of friction. Therefore, more glass must be used in the mop head to hold the same bulk of "hot stuff" as a typical cotton mop. As a result, the prior art glass yarn mop heads have the disadvantages of being expensive and very heavy. For example, a typical prior art glass mop head must weigh seven or eight pounds or more and include approximately 11,000 yarns to achieve the same bulk as a two or three pound cotton mop. A thirty inch sample of a single twisted yarn used in this typical prior art glass mophead weighs approximately 0.30 grams (0.00066 lbs.).

SUMMARY OF THE INVENTION

Briefly described, the present invention relates to a mophead which comprises a plurality of yarns. Each yarn comprises a filament structure including randomly disposed, but essentially continuous filaments or fibers. The filament structure comprises generally loosely entangled, non-parallel fibers in random disposition, each fiber extending essentially the full length of the yarn. The disposition of the fibers is random in that there is no apparent planned scheme as to the arrangement of each individual fiber of a yarn relative to the other fibers of the yarn. By coincidence some of the fibers might be parallel to one another. The fibers are untwisted, as the term is known in the industry, in that they are not wound about one another in a spiraling manner as by turning at either end. Each yarn comprising these fibers is expanded or fluffed out so as to be of comparatively large size or diameter and comparatively low density and non-uniformly textured along its length so that the entanglement or interlacing of the fibers tends to hold the fibers of the yarns together, with the fibers partially supporting one another. An example of the type of yarn described by this application is PPG Industries "Texo" 1.1 textured glass yarn. The yarns are bound together by a fixture to form a mop head for attachment to a handle.

The mop head of the present invention, comprising yarns including a mass of elongated randomly disposed glass fibers, combines the advantages of both cotton mop heads and glass mop heads to provide an improved mop head for use by roofers in the application of hot roofing tar. Contrary to what might have been expected, glass mop heads made in accordance with the present invention do not easily pull apart or string out in use. The mop heads of the present invention possess satisfactory tensile strength for proper performance of their intended use even though they comprise single ply yarns of untwisted fibers. The present mop heads carry and spread the "hot stuff" with ease and efficiency similar to a cotton mop head. The present mop head can easily withstand heat resulting from the normal operating temperatures of 400°–500° F. and can, in fact, withstand heat from higher temperatures of 800° F. and more without burning or other heat damage. Mop heads made in accordance with the present invention can be reused for approximately two and sometimes three times as long as cotton mop heads and perform efficiently. A three pound mop head constructed in accordance with the present invention is made of about 400 yarns and possesses approximately the bulk and density of a three pound cotton mop head. By comparison, a prior art roofer's mophead of glass yarns would be made of some 11,000 yarns and weigh about seven pounds.

The mop head of the present invention can be produced on high speed production equipment whereas the prior art glass mop heads are generally made by hand. Furthermore, the invented mop head can be made on existing equipment, with minor adjustments to the equipment used for producing cotton mop heads, whereas prior art mop heads cannot be made on such equipment.

Therefore, it is an object of the present invention to provide an improved mop head for use in the application of hot roofing tar.

Another object of the present invention is to provide an improved mop head comprising glass yarns including randomly disposed threads of glass fiber.

Another object of the present invention is to provide a glass mop head with a density comparable to a cotton mophead.

Yet another object of the present invention is to provide a lightweight glass mop head which weighs approximately three pounds for every 400 yarns and which is satisfactory for use in the application of roofing tar.

Still another object of the present invention is to provide a lightweight roofer's mop head comprising yarns with the density of a cotton mop head and the ability to withstand temperatures in excess of 800° F. without burning.

Still another object of the present invention is to provide a glass mop head which can be made on equipment, with minor adjustments, used for producing cotton mop heads.

Other objects, features and advantages of the present invention will become apparent upon reading and understanding the remaining specification, when taken in conjunction with the accompanying drawings.

DETAILED DESCRIPTION

Figure 1:
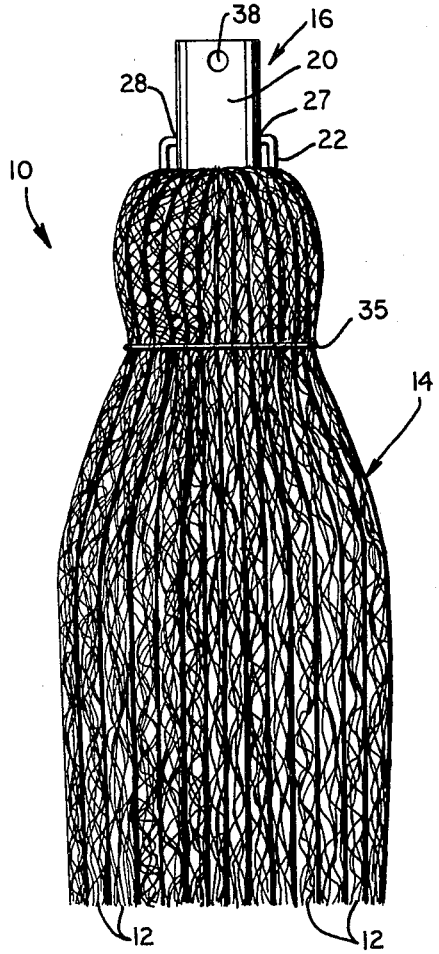
FIG. 1 is a pictorial view of a mophead in accordance with the present invention.
Figure 2:
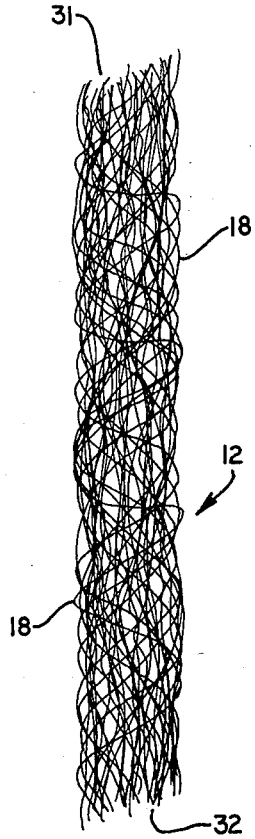
FIG. 2 is a pictorial representation of a single yarn of the mop head in FIG. 1 comprising untwisted, randomly disposed fibers.

Referring now in more detail to the drawings in which like numerals represent like components throughout the several views, the mop head 10 is shown in FIG. 1 as comprising a plurality of yarns 12 held together in a bundle 14 by a fixture 16. The yarns 12, as seen in FIG. 2, comprise a plurality of randomly disposed continuous glass filaments or threads or fibers 18. The majority of fibers 18 are not twisted togther with all fibers running in parallel alignment, but rather are loosely interlaced and entangled in a random manner to form yarn 12 in which, although some of the fibers may be aligned in parallel arrangement, the majority of fibers cross back and forth across other fibers in a randomly disposed arrangement. The fibers 18 each extend approximately the full length of the yarn 12.

Figure 3:
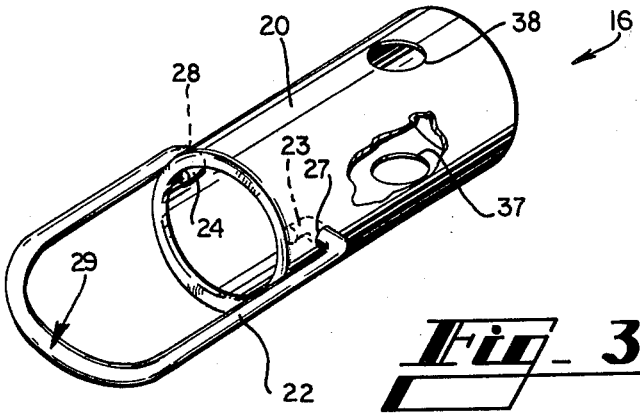
FIG. 3 is a pictorial view of the fixture of the mop head in FIG. 1.

A preferred fixture 16, as seen in FIG. 3 comprises a hollow tube or farrel 20 of, preferably, rolled steel piping or the like. A sturdy wire element or staple 22 is connected to the farrel 20 by punching or "stapling" the ends 23, 24 of the staple through the farrel thus forming diametrically opposed openings 27, 28 in the farrel. Although farrel 20 and staple 22 are shown connected together in FIG. 3 without the yarns 12 present, it should be noted that the staple and farrel are not a preassembled unit but rather are only connected in the finished mop as described below.

The yarn bundle 14 is attached to the fixture 16 as follows: The yarns 12 are stretched out along their lengths and laid next to one another to form the bundle 14. The number and length of yarns 12 included in the bundle 14 can vary depending on the size, or bulk, and weight of the bundle 14 desired. The staple 22, originally a straight wire element, is bent to define a loop 29 and the bundle 14 is placed within the loop 29 with the free ends 31, 32 of each yarn extending approximately equal distances to opposite sides of the staple. The farrel 20 is then brought into contact with the bundle 14 keeping the bundle of yarn between the staple loop 29 and the end of the farrel. The farrel 20 and staple 22 are then moved toward one another to compress the yarns 12 therebetween until a desired compression is achieved. A desired compression is, for example, 2200 lbs. of pressure exerted between the staple 22 and farrel 20. Once the desired compression is achieved, the staple 22 is bent further around the bundle 14 and, while the pressure, or compression, is maintained, the ends 23, 24 are punched, or stapled, into the farrel 20 forming diametrically opposed openings 27, 28 through which the staple is held fast to the farrel. The openings 27, 28 are not preformed in the farrel 20, since the positioning of the openings will vary depending on factors such as the length of the staple, the amount of desired compression, and the number of yarns in the bundle 14. After the bundle 14 of yarns 12 has been compressed onto the fixture 16, the yarns 12 hang from the staple 22 in a folded bundle 14 with the ends 31, 32 of each yarn 12 being approximately equal distances beyond the fixture. A wire band or strap 35 is wrapped around the bundle 14 to hold it in a neatly folded bundle. In the preferred embodiment, each yarn 12 remains a separate, individually perceivable yarn held with the other yarns 12 within the fixture 16 as a part of the composite bundle 14. The adjacent individual yarns 12 are not twisted or plied together and the only entanglement between adjacent yarns is coincidental. The farrel 20 is made hollow for accepting a mop handle (not shown) therein. Two screw holes 37, 38 are formed in the farrel 20 through which a nail or screw (not shown) can be extended for attaching the mop head 10 to the mop handle.

An example of a suitable three pound mop head 10, in accordance with the present invention is formed with approximately 380 to 410 glass fiber yarns 12, with the yarns being approximately 30 inches long from free end 31 to free end 32 of the yarns. Each thirty inch yarn 12 ranges in weight approximately from 3.3 to 3.5 grams (0.0073 to 0.0077 lbs.). The yarns can be fabricated from glass fibers 18 with about 800 fibers or filaments 18 to a yarn 12. The yarns 12 and thus the resulting bundle 14 can withstand the heat resulting from temperatures in excess of 800° F., including temperatures at least as high as 1400° F., without burning or other heat damage. The weight of the mop head, i.e., three pounds, represents the weight of the bundle 14 without the fixture 16.

While this invention has been described with particular reference to a preferred embodiment thereof, it will be understood that variations and modifications can be effected within the spirit and the scope of the invention as described hereinbefore and as defined in the appended claims.

I claim:

1. A mop head comprising:

a fixture; and a plurality of hanging, glass yarns maintained in a bundle by said fixture, each yarn including a plurality of entangled, randomly disposed glass fibers.

2. A mop head comprising:

a fixture for attaching the mop head to a handle; and a plurality of approximately equal length glass yarns attached to said fixture to define a bundle of glass yarns, each glass yarn including two free ends extending approximately equal distances from said fixture and each said glass yarn comprising a plurality of elongated glass fibers entangled with one another in random disposition with most fibers extending approximately the full length of said yarn, at least some of said fibers being arranged in non-parallel orientation with respect to others of said fibers, said bundle of glass yarns being resistant to and withstanding temperatures in excess of 800°

F. substantially without experiencing heat damage, and said plurality of glass yarns ranges in weight approximately from 2.9 to 3.1 pounds for every 400 yarns of approximately 30 inches each in length in which each said plurality of elongated glass fibers of each said yarn comprises approximately 800 fibers.

3. A mophead comprising:

a fixture;

a plurality of glass yarns bound together in a bundle by said fixture, each said glass yarn including a plurality of loosely entangled, non-parallel filaments crossing back and forth across one another in randomly disposed arrangement, and each said filament extending essentially the entire length of said yarn.

* * * * *